US007021092B2

(12) United States Patent
Loughlin et al.

(10) Patent No.: US 7,021,092 B2
(45) **Date of Patent: *Apr. 4, 2006**

(54) MULTIPLE FUNCTION LOCK

(75) Inventors: Robert Loughlin, Stanton, NJ (US); John Loughlin, Lebanon, NJ (US)

(73) Assignee: Stanton Concepts Inc., Stanton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/968,691

(22) Filed: Oct. 19, 2004

(65) Prior Publication Data

US 2005/0132764 A1 Jun. 23, 2005

Related U.S. Application Data

(63) Continuation-in-part of application No. 10/871,800, filed on Jun. 18, 2004, which is a continuation-in-part of application No. 10/845,624, filed on May 13, 2004.

(60) Provisional application No. 60/470,999, filed on May 16, 2003, provisional application No. 60/479,742, filed on Jun. 19, 2003, provisional application No. 60/482,853, filed on Jun. 26, 2003, provisional application No. 60/512,615, filed on Oct. 20, 2003, provisional application No. 60/590,201, filed on Jul. 22, 2004.

(51) Int. Cl.
*E05B 67/38* (2006.01)

(52) U.S. Cl. ..... 70/56; 70/25; 70/52; 70/285

(58) Field of Classification Search ..... 70/25–29, 70/50, 52–56, 284, 285, 30, 38 R–38 C
See application file for complete search history.

(56) References Cited

U.S. PATENT DOCUMENTS

| | | | |
|---|---|---|---|
| 14,059 | A | 1/1856 | Harrison, Jr. |
| 18,169 | A | 9/1857 | Yale |
| 25,428 | A | 9/1859 | Lyon |
| 44,007 | A | 8/1864 | Lorenz |

(Continued)

FOREIGN PATENT DOCUMENTS

| | | |
|---|---|---|
| CN | 590146 | 6/2004 |

OTHER PUBLICATIONS

Palos Sports, StopLock, Rotary dial combination school lock, www.palossports.com/store/proddetails.cfm/ItemID/1667/ CategoryID/7081/SubCatID/0/file.htm and www.locks4schools.com/stocklock.htm, Alsip, Illinois, Jun. 30, 2004.

(Continued)

*Primary Examiner*—Suzanne Dino Barrett
(74) *Attorney, Agent, or Firm*—Lerner, David, Littenberg, Krumholz & Mentlik, LLP

(57) ABSTRACT

A lock having a body, an engaging element having a first end, a locking mechanism for securing the first end to the body, the locking mechanism adapted to selectively conceal or reveal a passage in the body, through translation of a sliding gate, through which the first end may move to unlock the lock; the engaging element has a second end which is retained by the body at all times but is free to rotate. In other aspects, a lock has a body, a shackle having heel and toe portions, the heel portion engaged within the body, and a gate mechanism for selectively concealing or revealing a passage in the body from which the toe portion may move to unlock the lock, wherein movement of the toe portion is achieved through rotation of the toe about the heel.

15 Claims, 7 Drawing Sheets

U.S. PATENT DOCUMENTS

| | | | |
|---|---|---|---|
| 44,757 A | 10/1864 | Thomson | |
| 53,096 A | 3/1866 | Ascherfeld | |
| 61,055 A | 1/1867 | Decker | |
| 81,203 A | 8/1868 | Pease | |
| 81,204 A | 8/1868 | Pease | |
| 98,917 A | 1/1870 | Brooks | |
| 100,402 A | 3/1870 | Hillebrand | |
| 104,038 A | 6/1870 | Kitson et al. | |
| 109,718 A | 11/1870 | Corbett et al. | |
| 122,082 A | 12/1871 | Tassel | |
| 177,814 A | 5/1876 | Delkescamp | |
| 206,528 A | 7/1878 | Bramble | |
| 210,844 A | 12/1878 | Ferret | |
| 221,595 A | 11/1879 | Mix | |
| 229,003 A | 6/1880 | Mason | |
| 248,835 A | 11/1881 | Adams | |
| 256,399 A | 4/1882 | Spielman | |
| 274,875 A | 3/1883 | Yoe | |
| 280,649 A | 7/1883 | Menzies | |
| 297,445 A | 4/1884 | Plumb | |
| 370,618 A | 9/1887 | Taylor | |
| 374,592 A | 12/1887 | Gilman | |
| 417,602 A | 12/1889 | Straubinger | |
| 418,884 A | 1/1890 | Bramble | |
| 502,307 A | 8/1893 | Lowrie | |
| 512,979 A | 1/1894 | Lowrie | |
| 534,653 A | 2/1895 | Lenhart et al. | |
| 549,951 A | 11/1895 | Belanger | |
| 621,391 A | 3/1899 | Turner | |
| 628,161 A | 7/1899 | Homman | |
| 686,882 A | 11/1901 | Ballou | |
| 837,295 A | 12/1906 | Fisher | |
| 858,264 A | 6/1907 | Daugherty | |
| 880,932 A | 3/1908 | Swoggers | |
| 912,773 A | 2/1909 | Augenbraun | |
| 948,853 A | 2/1910 | Gilroy | |
| 972,171 A | 10/1910 | Dupont | |
| 1,092,474 A | 4/1914 | Carroll | |
| 1,222,082 A | 4/1917 | Descalles | |
| 1,284,655 A | 11/1918 | Greber | |
| 1,347,467 A | 7/1920 | Scott et al. | |
| 1,363,599 A | 12/1920 | Hull et al. | |
| 1,367,647 A | 2/1921 | Washburn | |
| 1,384,577 A | 7/1921 | Swan | |
| 1,401,030 A | 12/1921 | Ashkar | |
| 1,424,543 A | 8/1922 | Wiloch | |
| 1,426,978 A | 8/1922 | Gambino | |
| 1,469,233 A | 10/1923 | Messina et al. | |
| 1,520,902 A | 12/1924 | Junkunc | |
| 1,527,336 A | 2/1925 | Voda | |
| 1,618,997 A | 3/1927 | Radandt | |
| 1,659,433 A | 2/1928 | Kroll | |
| 1,689,305 A | 10/1928 | Spano | |
| 1,712,476 A | 5/1929 | Coiro | |
| 1,718,723 A | 6/1929 | Williams | |
| 1,719,309 A | 7/1929 | Radosevic | |
| 1,755,521 A | 4/1930 | Smith | |
| 1,828,747 A | 10/1931 | Perry | |
| 1,835,317 A | 12/1931 | Miller | |
| 1,857,399 A | 5/1932 | Piagneri | |
| 1,867,689 A | 7/1932 | Van Leer | |
| 1,892,964 A | 1/1933 | Rainey | |
| 1,902,665 A | 3/1933 | Reinhold | |
| 2,001,262 A | 5/1935 | North | |
| 2,079,578 A | 5/1937 | Schlesinger et al. | |
| 2,116,965 A | 5/1938 | Schoorel et al. | |
| 2,140,490 A | 12/1938 | Wise | |
| 2,159,291 A | 5/1939 | Quintal | |
| 2,163,121 A | 6/1939 | Holtzman | |
| 2,163,852 A | 6/1939 | Pond | |
| 2,179,045 A | 11/1939 | Lewis | |
| 2,185,899 A | 1/1940 | Nehls | |
| 2,248,695 A | 7/1941 | Bradshaw | |
| 2,319,753 A | 5/1943 | Smith et al. | |
| 2,362,999 A | 11/1944 | Hewitt | |
| 2,479,199 A | 8/1949 | Bennett et al. | |
| 2,488,986 A | 11/1949 | Richter | |
| 2,497,619 A | 2/1950 | Mass | |
| 2,508,302 A | 5/1950 | Stue | |
| 2,544,305 A | 3/1951 | Finke et al. | |
| 2,546,182 A | 3/1951 | Fenari | |
| 2,623,378 A | 12/1952 | Haver | |
| 2,655,805 A | 10/1953 | Fletcher | |
| 2,666,318 A | 1/1954 | Welch | |
| 2,686,447 A | 8/1954 | Vock et al. | |
| 2,770,998 A | 11/1956 | Schwartz | |
| 2,834,195 A | 5/1958 | Stackhouse | |
| 3,241,408 A | 3/1966 | McCauley | |
| 3,330,586 A | 7/1967 | Becker | |
| 3,363,500 A | 1/1968 | Simko | |
| 3,400,626 A | 9/1968 | Bergere | |
| 3,412,635 A | 11/1968 | Chmielewski | |
| 3,498,173 A | 3/1970 | Wright | |
| 3,546,906 A | 12/1970 | Yang | |
| 3,572,063 A | 3/1971 | Foote | |
| 3,581,530 A | 6/1971 | Raspadori | |
| 3,584,667 A | 6/1971 | Reiland | |
| 3,592,027 A | 7/1971 | Wako | |
| 3,750,431 A | 8/1973 | Atkinson | |
| 3,808,984 A | 5/1974 | Teleky | |
| 3,823,584 A | 7/1974 | Gill | |
| 3,837,189 A | 9/1974 | Atkinson | |
| 3,841,118 A | 10/1974 | Stone | |
| 3,874,258 A | 4/1975 | Semola et al. | |
| 3,952,559 A | 4/1976 | Atkinson | |
| 3,973,418 A | 8/1976 | Close | |
| 3,987,653 A | 10/1976 | Lyon et al. | |
| 4,006,660 A | 2/1977 | Yamamoto et al. | |
| 4,015,456 A | 4/1977 | Moberg | |
| 4,027,572 A | 6/1977 | Burge | |
| 4,066,195 A | 1/1978 | Dickler | |
| 4,070,879 A * | 1/1978 | Thompson | 70/20 |
| 4,073,165 A | 2/1978 | Grundstrom et al. | |
| 4,161,896 A | 7/1979 | Creed | |
| 4,170,918 A | 10/1979 | Burge | |
| 4,191,228 A | 3/1980 | Fenton | |
| RE30,243 E | 4/1980 | Oliver | |
| 4,211,128 A | 7/1980 | Plumer | |
| 4,216,664 A | 8/1980 | Slavinsky | |
| 4,280,726 A | 7/1981 | McCoag | |
| 4,325,240 A | 4/1982 | Gable | |
| 4,332,153 A | 6/1982 | Miles | |
| 4,351,171 A | 9/1982 | Tsui | |
| 4,483,164 A | 11/1984 | Nielsen, Jr. et al. | |
| 4,499,745 A | 2/1985 | Ricouard et al. | |
| 4,557,122 A | 12/1985 | Hwang | |
| 4,655,062 A | 4/1987 | Kaufman | |
| 4,671,088 A | 6/1987 | Jeang | |
| 4,690,443 A | 9/1987 | Brammall | |
| 4,730,467 A | 3/1988 | Lebrecht | |
| 4,751,830 A | 6/1988 | Cheng | |
| 4,770,013 A | 9/1988 | Nakai | |
| 4,809,569 A | 3/1989 | Erb | |
| 4,823,566 A | 4/1989 | Patton | |
| 4,823,567 A | 4/1989 | Patton | |
| 4,829,795 A | 5/1989 | Taylor | |
| 4,838,052 A | 6/1989 | Williams et al. | |
| 4,841,753 A | 6/1989 | Patton | |
| 4,862,714 A | 9/1989 | Taylor et al. | |
| 4,866,958 A | 9/1989 | Bretl et al. | |
| 4,884,419 A | 12/1989 | Ling | |
| 4,885,923 A | 12/1989 | Nakai | |
| 4,918,951 A | 4/1990 | Kavizky | |
| 4,952,228 A | 8/1990 | Taylor et al. | |

| | | | | |
|---|---|---|---|---|
| 5,020,342 | A * | 6/1991 | Doan et al. | 70/14 |
| 5,033,279 | A | 7/1991 | Lebrecht | |
| 5,134,869 | A | 8/1992 | Gable | |
| 5,137,407 | A | 8/1992 | Yamamoto | |
| 5,193,367 | A | 3/1993 | Ling | |
| 5,195,342 | A | 3/1993 | Werner | |
| 5,237,842 | A | 8/1993 | Rasch et al. | |
| 5,279,190 | A | 1/1994 | Goss et al. | |
| 5,347,689 | A | 9/1994 | Georgopoulos et al. | |
| D352,886 | S | 11/1994 | Taylor | |
| 5,361,614 | A | 11/1994 | Metcalf | |
| 5,367,785 | A | 11/1994 | Benarroch | |
| 5,378,101 | A | 1/1995 | Olson et al. | |
| D360,125 | S | 7/1995 | Taylor | |
| 5,485,734 | A | 1/1996 | Yang | |
| D370,618 | S | 6/1996 | Taylor | |
| 5,582,049 | A | 12/1996 | Mauer | |
| 5,666,831 | A | 9/1997 | Doros | |
| 5,694,797 | A | 12/1997 | Kuo | |
| 5,715,709 | A | 2/1998 | Lai | |
| 5,732,989 | A | 3/1998 | Stevenson et al. | |
| 5,737,947 | A | 4/1998 | Ling | |
| 5,749,610 | A | 5/1998 | Brammall et al. | |
| 5,839,302 | A | 11/1998 | Chu | |
| 5,868,012 | A | 2/1999 | Chun-Te et al. | |
| 5,878,604 | A | 3/1999 | Stone et al. | |
| 5,931,030 | A | 8/1999 | Chen | |
| 5,987,939 | A | 11/1999 | Pitisettakarn | |
| 6,047,575 | A | 4/2000 | Larson et al. | |
| 6,173,592 | B1 | 1/2001 | Yu | |
| 6,227,016 | B1 | 5/2001 | Yu | |
| 6,233,984 | B1 | 5/2001 | Blehi, III | |
| D450,232 | S | 11/2001 | Taylor et al. | |
| 6,389,854 | B1 | 5/2002 | Huang | |
| 6,408,660 | B1 | 6/2002 | Lai | |
| 6,453,706 | B1 | 9/2002 | Chen | |
| 6,464,269 | B1 | 10/2002 | Wilhelm et al. | |
| 6,494,070 | B1 | 12/2002 | Moss et al. | |
| 6,508,086 | B1 | 1/2003 | Chen | |
| 6,508,089 | B1 | 1/2003 | Tsai | |
| 6,513,356 | B1 | 2/2003 | Yang | |
| 6,513,357 | B1 | 2/2003 | McCurry | |
| 6,516,643 | B1 | 2/2003 | Olshausen | |
| 6,539,761 | B1 | 4/2003 | Yang | |
| 6,546,763 | B1 | 4/2003 | Pielach | |
| 6,546,764 | B1 | 4/2003 | Segawa | |
| 6,584,819 | B1 | 7/2003 | Hung | |
| 6,598,434 | B1 | 7/2003 | Yang | |
| 6,604,393 | B1 | 8/2003 | Larsen et al. | |
| 6,708,534 | B1 | 3/2004 | Ruan | |
| 6,722,166 | B1 | 4/2004 | Skjellerup | |
| 6,725,692 | B1 | 4/2004 | Weinraub | |
| 6,729,166 | B1 | 5/2004 | Lai | |
| 6,739,796 | B1 | 5/2004 | Del Nero et al. | |
| 6,766,673 | B1 | 7/2004 | Gast et al. | |
| 6,843,080 | B1 | 1/2005 | Yu | |
| 6,848,283 | B1 | 2/2005 | Lin | |
| 6,860,125 | B1 * | 3/2005 | Yu | 70/25 |
| 2001/0039818 | A1 | 11/2001 | Jones et al. | |
| 2002/0088256 | A1 | 7/2002 | Taylor et al. | |
| 2002/0129628 | A1 | 9/2002 | Skalberg | |
| 2002/0139155 | A1 | 10/2002 | Franzen | |
| 2003/0089147 | A1 | 5/2003 | Yang | |
| 2004/0083782 | A1 | 5/2004 | Lantz | |
| 2004/0226323 | A1 | 11/2004 | Ling et al. | |
| 2005/0034492 | A1 | 2/2005 | Yu | |
| 2005/0039500 | A1 | 2/2005 | Yu | |
| 2005/0039501 | A1 | 2/2005 | Yu | |
| 2005/0044900 | A1 * | 3/2005 | Yu | 70/25 |
| 2005/0044901 | A1 * | 3/2005 | Yu | 70/25 |
| 2005/0044902 | A1 * | 3/2005 | Yu | 70/25 |
| 2005/0044903 | A1 * | 3/2005 | Ling et al. | 70/30 |

OTHER PUBLICATIONS

Tanner Corp., The Tanner Product Line, Security Fasteners, Tamper-Resistant Products, www.tannerbolt.com, Brooklyn, New York.

Cross Check Bolt Seal and Hydro Check Removal Tool, Tyden Brammall, 409 Hoosier Drive, Angola, IN 46703.

E. J. Brooks Company, Reusable Trans-Lok Seal TM, www.ejbrooks.com, Livingston, New Jersey, Apr. 13, 2003.

McGard Special Products Division, Innovative Security Solutions, The Intimidator, Orchard Park, New York, Revised Jun. 2002.

www.palossports.com/store/proddetails.cfm/ItemID/1667/CategoryID/7081/SubCatID/0/file.htm.

E. J. Brooks Company, Reusable Trans-Lok Seal TM, www.ejbrooks.com, Livingston, New Jersey, Apr. 13, 2003.

Provisional Application U.S. Appl. No. 60/443,331, filed Jan. 29, 2003.

* cited by examiner

MULTIPLE FUNCTION LOCK

CROSS REFERENCE TO RELATED APPLICATIONS

The present application is a continuation-in-part of U.S. patent application Ser. No. 10/871,800 filed Jun. 18, 2004, which is a continuation-in-part of U.S. patent application Ser. No. 10/845,624 filed May 13, 2004, which claims the benefit of the filings dates of U.S. Provisional Patent Application Ser. Nos. 60/470,999 filed May 16, 2003; 60/479,742 filed Jun. 19, 2003; 60/482,853 filed Jun. 26, 2003; and 60/512,615 filed Oct. 20, 2003. The present invention also claims the benefit of the filing date of U.S. Provisional Patent Application No. 60/590,201 filed Jul. 22, 2004. The disclosures of each of the aforementioned applications are hereby incorporated herein by reference.

BACKGROUND OF THE INVENTION

Conventional locks, such as padlocks employing U-shaped shackles, are extremely popular. One reason for their popularity is the ease and convenience of their attachment to, and fit with, the hasps and other attachment mechanisms of devices with which they are used to provide for the unlatching and opening of the secured assembly.

The latching and locking functions of conventional locks most often involve the manipulation of an engaging element with respect to a captive element. The captive element typically includes a captive space, or cavity, within which the engaging element may be secured. When secured, the lock is locked and when unsecured the lock is unlocked. Conventional engaging elements are commonly referred to as shackles or bolts, depending on the category of lock being described. Nevertheless, conventional shackles and bolts generally work off similar principles known in the art.

The locks most frequently in use today rely on a single locking mechanism, most typically being operated by a key or a combination lock. Although such locks may be padlocks employing U-shaped shackles, or other locks utilizing bolts, for ease of reference, padlocks will generally be discussed herein. As previously stated, conventional padlocks may employ either a key operated locking element or a combination locking element. In a conventional padlock, the heel of the shackle is associated with the locking element and may be lifted from the body of the lock when the locking element is disengaged. Such lifting typically releases the toe permitting the shackle to be rotated to an open position.

Notwithstanding the utility of such locks, it will be appreciated that there are conditions in which more optimal designs are being sought. For example, in areas where locks are exposed to external elements such as moisture, traditional key and combination locking mechanisms may become increasingly more difficult to use over time through the formation of rust between the interior components of the lock. Other problems are dirt and debris, which may enter the locking mechanism and jam the lock. Once the locking mechanism of the conventional lock is compromised beyond use, the lock must be removed destructively and sacrificed. This solution has increasingly become problematic as the cost of locks continues to rise, and the need for locks which are exposed to outside weather conditions, yet experience only infrequent use, has increased.

Thus, it would be advantageous to provide a novel lock which is less susceptible to being compromised by adverse weather conditions and infrequent use. It would also be advantageous for such a lock to be capable of employing a security level greater than that which may be achieved by a conventional lock.

This increased security level may be provided by the requirement that the lock be opened by a specific tool, which may apply a force to the lock which is much greater than that which may be applied by a conventional key. In addition, the locks may be provided with tamper indicative seals or other such devices.

Tamper indicative devices such as PRIVASEAL® brand protective seals have long been used as one time use security elements to provide evidence of tampering or access to secured objects. PRIVASEAL® is a registered trademark of Stanton Concepts, Inc., P.O. Box 139, Stanton, N.J. Locks incorporating seals as part of the security function in combination with key or keyless (combination) mechanisms are known. The seals are typically incorporated into the conventional locks such that the integrity of the seal is compromised upon opening or attempted opening of the lock to indicate access or tampering. Preferably, the seal is arranged such that tampering is readily apparent upon initial visual observation.

In addition to mechanical indicative devices, it may also be advantageous for such a lock to include a higher level of sophistication by including provisions to electronically store information about the lock, such as when the lock was opened, where the lock was when opened, and/or what operator opened the lock, either within the lock itself or through a communication device to a remote station. Alternatively, the lock itself may not include such provisions, but may be coupled with a tool that incorporates these novel security features.

SUMMARY OF THE INVENTION

In accordance with one aspect of the present invention, a lock may be provided comprising a body having a passage therein, a shackle having heel and toe portions, the heel portion engaged within the body and the toe portion being adapted to move into and out of the passage in the body, and a gate mechanism for selectively concealing or revealing the passage in the body from which the toe portion may move to unlock the lock, wherein movement of the toe portion may be achieved through rotation of the toe portion about an axis aligned with the heel portion.

The gate mechanism may further comprise a blocking element, the blocking element concealing or revealing the passage through translation of the blocking element. Translation of the blocking element may be achieved along a path parallel to the length of the shackle.

The lock may further comprise a spring operatively engaged with the gate mechanism, the spring adapted to influence the gate mechanism into a position concealing the passage.

The blocking element may further comprise at least one mating element with which a tool may be mated. The at least one mating element may comprise a plurality of recesses within the blocking element.

The heel portion may further comprise a channel extending around its diameter wherein the heel portion may be retained within the body by a ball bearing.

The toe portion may further comprise a slot and the body may further comprise a bar, the bar fitting within the slot when the toe portion is rotated within the body to prevent the toe portion from being pulled from the body.

The gate mechanism may further comprise an aperture extending therethrough, the aperture adapted to receive a pin to maintain the gate mechanism in a position revealing the passage. The pin may contact a bottom of the lock when the pin is inserted into the aperture with the gate mechanism revealing the passage.

The lock may further comprise a second locking mechanism, the second locking mechanism being operative to retain the toe portion within the body when the gate mechanism is in the position revealing the toe portion. The second locking mechanism may comprise a keyed cylinder. The second locking mechanism may comprise a tool-engaging interface.

In accordance with another aspect of the present invention, a lock may comprise a body having a passage and a sliding gate associated with the passage, an engaging element having a first end, a locking mechanism for securing the first end to the body, the locking mechanism adapted to selectively conceal or reveal the passage in the body through translation of the sliding gate, the first end being moveable through the passage to a position to unlock the lock.

The engaging element may further comprise a second end, the second end being retained by the body at all times. The second end may be free to rotate within the body.

The engaging element may extend a first direction and translation of the sliding gate may be achieved through a path parallel to the first direction.

The lock may further comprise a spring adapted to urge the locking mechanism toward the position concealing the passage.

The lock may further comprise at least one mating element associated with the locking mechanism, the mating element adapted to be mated with a tool for selectively revealing or concealing the passage.

In accordance with a further aspect of the present invention, a lock may comprise a body having a cutout, an outer shell partially surrounding the body, a shackle, the shackle having a first end affixed to the body such that the first end may be capable of rotation, the shackle having a second end adapted to fit within the cutout, wherein the outer shell may be adapted to slide relative to the body between a first position concealing the cutout and a second position relative to the body revealing the cutout, the second end of the shackle being free to enter or leave the cutout when the outer shell may be in the second position.

The outer shell may further comprise at least one mating element, the mating element adapted to associate with a tool to move the outer housing between the first position and the second position. The at least one mating element may comprise at least one aperture.

The lock may further comprise a spring arranged in the body and adapted to bias the outer housing toward the first position.

The outer housing may further comprise an elongated aperture through which the first end of the shackle extends. The elongated aperture may define the limit of excursion of the outer housing relative to the body. The outer housing may further comprise an opening, the opening being flush with the body when the outer housing is in the first position.

The lock may further comprise a locking mechanism, the locking mechanism selectively moveable between a lock position and an unlock position, the locking mechanism preventing rotation of the shackle when in the lock position and permitting rotation of the shackle about the first end when in the unlock position. The locking mechanism may be only capable of selectively moving between the lock position and the unlock position when the outer housing is in the second position.

The outer housing may further comprise an aperture, the aperture being moved into registration with the locking mechanism when the outer housing is in the second position, and the outer housing covering the locking mechanism when the outer housing is in the first position.

The outer housing may be movable in a direction perpendicular to the shackle between the first position and the second position of the shackle.

In accordance with still a further aspect of the present invention, a tool for use with a lock having a body, a shackle having heel and toe portions, the heel portion rotatably engaged within the body and the toe portion adapted to reside in a cutout of the body, and a gate mechanism for selectively concealing or revealing the cutout into which the toe portion may move to lock the lock, or from which the toe portion may move to unlock the lock may be provided, the tool comprising a structure adapted to operate the gate mechanism.

The structure may further comprise a first engaging element extending from a first jaw and a second engaging element extending from a second jaw, the first engaging element adapted to mate with the gate mechanism and the second engaging element adapted to mate with the body. The tool may further comprise a first handle connected to the first jaw, a second handle connected to the second jaw, and a ratcheting mechanism, the ratcheting mechanism adapted to move the first jaw in proximity to the second jaw upon repeated actuation of the first and second handles.

The tool may be power operated. The power for operating the tool may be hydraulic power. The power for operating the tool may be pneumatic power. The power for operating the tool may be electric power.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

In regard to the drawings.

DETAILED DESCRIPTION

Figure 1A:
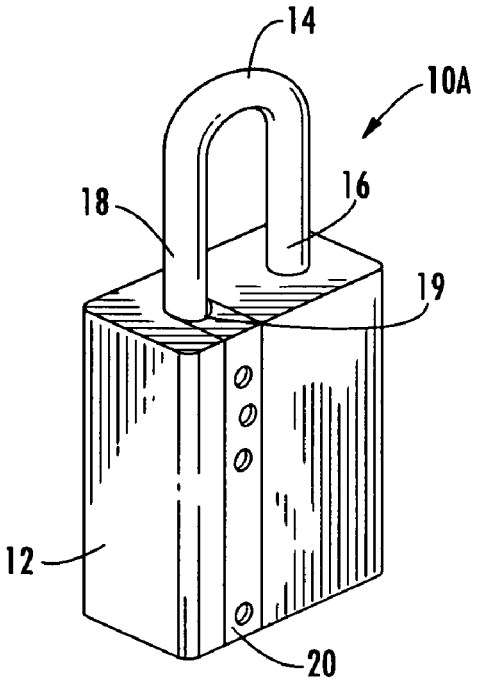
FIG. 1A is a perspective view of a lock in accordance with one aspect of the present invention shown in the locked position.

In the following are described the preferred embodiments of the multiple function lock in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

It will become evident to one skilled in the art that several objectives and advantages of this invention follow from the novel method by which the traditional security functions are achieved using tool operated restricting components to secure conventional engaging elements.

In conventional padlock-style security locks, the key or combination locking and latching function engages the heel and toe of the U-shaped shackle within the lock body to provide security. The lock may be unlocked, unlatched and opened by manipulating the locking mechanism, lifting the shackle to free the toe from a cavity provided in the body and rotating the toe away from the body, all while the heel remains retained within the body.

An alternate method for freeing the toe to permit the rotation of the shackle to the open position without the traditional lifting motion is presented herein. This novel method is achieved by moving a restricting cavity or restricting component out of engagement with the toe of the shackle. This motion may be achieved by use of a specialized tool that engages the restricting component and provides for its realignment or shifting. This movement disengages the shackle from the body at the toe, permitting the shackle to be rotated to the open position. This realignment motion may also be achieved in conjunction with a conventional locking element when such is appropriate to the application. The action is reversed to return the shackle to the engaged, locked, and secure position.

The present invention includes the provision of novel manipulation means of the restricting component of the lock preferably by means of a mechanical or motor driven tool. The authorization necessary to drive the tool in the direction appropriate for unlocking a given lock may be provided by means of a signal, electronic, electromagnetic, optical, or otherwise, from a preferably secure reference source. The signal may be obtained from a radio frequency reference device (RFID), mote (a new class of interactive microelectronic device, also commonly referred to as "smart dust" or "wireless sensing networks"), contact memory buttons (CMB) (a non-powered read/write memory device capable of transferring data by contact), optical barcode, magnetic strip or similar encrypted medium. This source may provide the unique identification, and/or history of activity for the lock, in addition to other information.

Embodiments of locks suited for the present invention may include locks applied to doors of all sorts, security cabinets and containers, trucking/railway containers, safes, and similar fixed structures. The same teachings may also be applied to portable locking devices (padlocks) of various configurations such as U-shackle style, straight shackle style, hidden shackle style, or any other portable locking device. These various embodiments may be used wherever the popular key function or externally manipulated code (combination) mechanisms have been the lock of choice, such as in perimeter securement, vending machines, trucking/railway/intermodal containers, etc.

The tools utilized as part of this invention may be of several levels of sophistication. In an initial or first level, a "dumb" tool may provide simple, specific and perhaps proprietary, mechanical actions to unlock the lock. In general, a " dumb" tool requires the thought process and possibly mechanical strength of a person to operate the tool to unlock a lock. Typically, a "dumb" tool requires the operator to cause the tool to drive the lock through the appropriate excursion in a manual manner. Although manual, the tool may incorporate hydraulics, electric motors, pneumatics, or mere mechanical advantage to achieve the level of force required to unlock a lock.

In a second level of sophistication, a "not so dumb" tool may be provided. In addition to meeting the description of a "dumb" tool above, the "not so dumb" tool may incorporate means to identify the particular lock intended to be opened, without input from the operator. In essence, therefore, the operator merely mates the tool with the lock and the tool functions to open the lock based on identifying characteristics read or otherwise obtained from the lock itself. The means of identifying the lock may be a signal, electronic, electromagnetic, optical, or otherwise, from the lock. As previously discussed, the signal may be obtained from an RFID, mote, CMB, optical barcode, magnetic strip or similar encrypted medium.

A "not so dumb" tool of this second level may also include added security features such as radio frequency (RF) tagging, optics, global positioning systems (GPS), cellular triangulation, or similar tracking means. For example, if the tool were moved outside of a designated area, the tool may be automatically disabled. In addition, the tool may incorporate a memory module to record an audit trail of operations.

A "not so dumb tool" may also include a "lock out" mechanism to protect against unauthorized use. This "lock out" mechanism may be a simple mechanical key cylinder or an electro mechanical device that enables the tool to operate only after the satisfaction of requirements such as personal identification numbers (pin), passwords, pass cards, biometrics, implanted chips, or specific windows of time or other criteria. In this regard, the operator may be required to provide such validation means for the tool to operate. In certain aspects of the invention, the tool may not indicate that the "lock out" function has been activated, and may capture the lock upon attempted use without user validation, without opening the lock.

In yet a higher third level of sophistication, a "smart tool" may build on the description of the "not so dumb tool" by including provisions to communicate with a remote station to provide some or all of the functions identified with a "not so dumb" tool. In this regard, the central station may then monitor use of the tool and/or locks in real time, and may provide immediate security functions not available in the "not so dumb" tool, such as immediate shutdown of all tool functioning upon a breach of security. In the "smart tool," the audit trail may be captured at the remote station, rather than, or in addition to, a memory module within the tool itself.

Whether of a first or "dumb" level, a second or "not so dumb" level or a third or "smart" level, the tool may interface to the lock with a mating drive. Possible drive interfaces will be discussed further below. The tool is preferably able to manipulate the restricting component a predetermined excursion distance to unlock the lock through activation of the mating drive.

Each lock may include a unique identification number that can be read either manually and entered manually into the tool, as in a "dumb" tool, or read automatically by the tool via RF tagging, magnetic interfaces, optical barcode scanning, motes, CMBs or the like, as in a "not so dumb" or "smart" tool. In the case of manual identification, such as barcodes or optical interfaces, the manual identification may be internal to the lock to prevent manual reading of the barcode data by the tool operator. The tool may then communicate the information to the operator for his subsequent operation of the tool's motor driven lock opening mechanism.

The "smart tool" may have provisions such that it may be enabled only after the operator has been identified and qualified by the security system. This identification and qualification procedure may be conducted through a pin number, a password, a passkey, biometrics, implanted chip, or other device, which may be communicated to a remote location. The link from the tool to the remote database may use existing wired or wireless technology such as cellular, radio, satellite, wired landlines, or other means (the wired lines preferably including provisions within the tool for connection with standard telephone lines, cable lines, local area network lines, or the like for remote communication). At the remote database a complete audit trail could be maintained including location by GPS or cellular triangulation. Discovery of theft or fraudulent use could result in a disabling lockout of the tool, capture of the tool, or another response as appropriate. All communications between the tool and the remote database may be encrypted for security purposes.

In other aspects of the invention, the lock itself may be hard-wired to a communication system for communicating with the remote station. For example, a lock contained in a door of a typical office may include provisions for communicating operation times to a remote database via telephone line hard-wired directly into the lock.

In other embodiments, multiple locking elements may be employed. For example, the lock may employ a first locking mechanism which may be manipulated to reveal a second locking mechanism, rather than to open the lock directly. The general concept of revealing a second mechanism is known in the art and finds utility in providing multiple levels of security within a single unit. Often, locks with this general feature are known in the industry as "trick" locks. However, here, one of the multiple locking mechanisms may be independent from the others and may operate in accordance with the novel teachings of this invention.

Multiple separate locking mechanisms may be incorporated into a single lock. As applied to certain embodiments of the present invention, the specialized tool may therefore be utilized to unlock a first locking mechanism to reveal a subsequent locking mechanism, where the subsequent locking mechanism is operative to free the toe of the shackle. In certain embodiments, the sequence of locking mechanisms may be altered, such that the tool is not necessarily the final locking mechanism manipulated to unlock the toe of the shackle. Rather, yet another locking mechanism may be required to be undone to unlock and open the lock.

It will be appreciated that when used herein, the term "tool" shall be construed broadly to include at least those devices used to facilitate manual or mechanical work, such as instruments or apparatus used in performing an operation or which are necessary for the practice of a vocation. The definition of "tool" shall be construed broadly to include devices which incorporate a mechanical advantage and/or structure to withstand a torsional or other force implemented to initiate the mechanical advantage, as well as devices which do not incorporate a mechanical advantage, such as tools utilizing the principles of electronics, magnetism, hydraulics, pneumatics, or the like. The tools may also be power driven such as a conventional drill or the like.

One subset of tools is keys. "Keys" shall be construed more narrowly than tools herein to include only conventional keys having differentiated patterns, or bitting, and which are adapted to manipulate a lock mechanism without the influence of a substantial mechanical advantage. Examples of such keys are those used to operate conventional pin tumbler cylinder locks.

With regard to the figures, FIG. 1A depicts a perspective view of a lock in accordance with one embodiment of the present invention, where the lock is shown in the completely locked position. As shown in FIG. 1A, the lock 10A may comprise a lock body 12 with a U-shaped shackle 14 engaged to the body at its heel 16 and toe 18. The body 12 may also comprise a sliding gate 20, capable of being slid out of position to expose the toe 18 of the shackle 14, permitting rotation thereof about the heel 16 of the shackle.

Figure 3A:
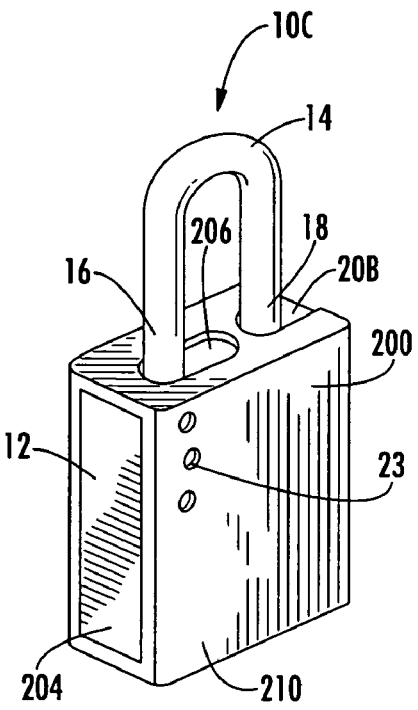
FIG. 3A is a perspective view of a lock in accordance with a further aspect of the present invention shown in the locked position.

The sliding gate 20 in this embodiment is translatable in the vertical orientation relative to the lock body 12, but may also, in other embodiments, be oriented horizontally across the body 12 of the lock 10A. In this regard, as the typical shackle 14 is taller than it is wide, the vertical orientation of the sliding gate, as shown in FIG. 1A, may be referred to as sliding parallel to the shackle, i.e. along a direction which coincides with the axis about which the shackle rotates. Conversely, a horizontal sliding mechanism (as shown in FIG. 3A) may be referred to as sliding perpendicular to the shackle.

Figure 1B:
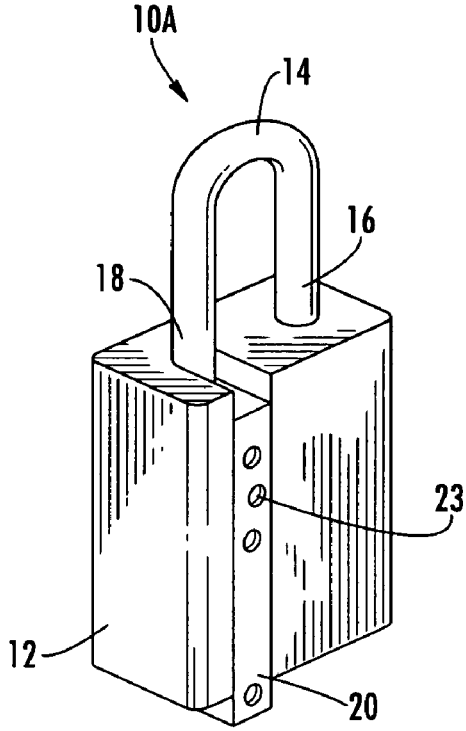
FIG. 1B is a perspective view of the lock of FIG. 1A shown in the partially open position.

FIG. 1B depicts a perspective view of the lock 10A of FIG. 1, with the sliding gate 20 moved out of its closed position, to the entire excursion distance required to release the toe 18 of the shackle 14. It will be appreciated that such translation is preferably achieved through the use of a tool, as will be described more fully below. The sliding gate 20 may be provided with attachment points, or mating elements 23, with which the tool may be mated to provide the necessary interfaces between the tool and the lock 10A.

As shown in FIG. 1B, the mating elements 23 may comprise three cavities arranged in a predetermined orientation. By arranging the cavities in varied orientations, a degree of security may be provided in that only a tool with matching elements may be utilized to operate the lock 10A. Such orientations may be particular to a given lock owner, such that one tool may open all of the locks 10A of the particular owner, or may be particular to a given class of locks, such that one tool may open each of the locks of that particular class.

Not only may the orientations of the mating elements of different locks be manipulated, but the number of mating elements 23 may be altered as well. It will be appreciated that other than being limited by practicality, there is virtually no limit to the minimum or maximum number of mating elements 23 provided. For example, on the minimum end, the mating elements 23 must provide for the insertion of matching elements on the tool that will be capable of withstanding the forces required to operate the lock. A single mating element 23 may therefore be provided, so long as the mating element is of a sufficient size to permit the matching element of the tool to withstand the forces required to open the lock. On the other end of the spectrum, many mating elements 23 may be provided, so long as there is sufficient room on the sliding gate 20.

It will be appreciated that other mating elements may also be provided. For example, although not shown, the sliding gate 20 may include a threaded tap in its bottom surface. An appropriate tool may engage the threaded tap to pull the sliding gate 20 to the open position.

The surface 19 of the sliding gate 20 directly adjacent to the toe 18 is preferably crescent shaped, such that it is formed concentric with the toe. In addition, it is preferable that the gap between the toe 18 and the crescent-shaped surface 19 be minimal, such that the gap may not be an attraction point for those that might forcefully attack the lock 10A. A minimal gap also assists with preventing debris from entering the lock 10A.

Figure 1C:
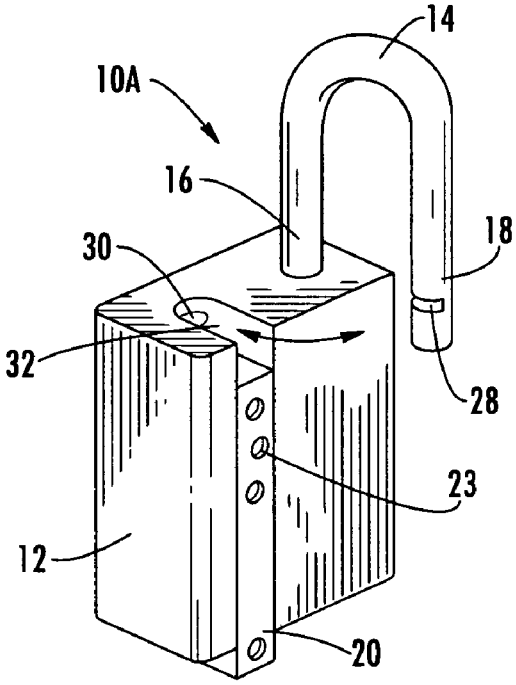
FIG. 1C is a perspective view of the lock of FIG. 1A shown in the open position.
Figure 1D:
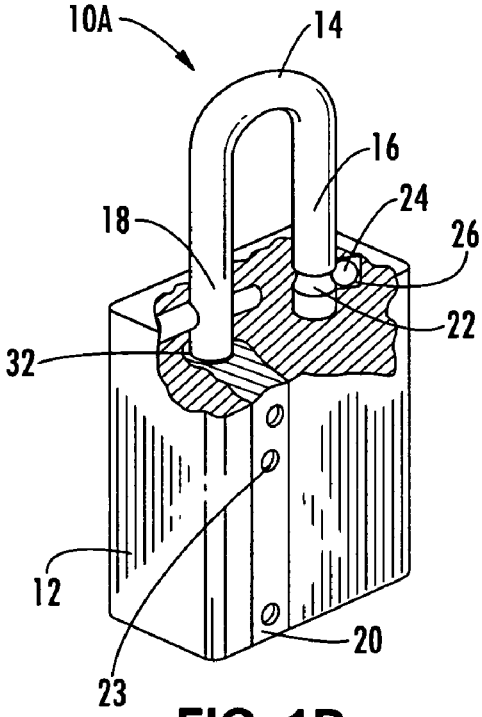
FIG. 1D is a partially cut-away perspective view of the lock of FIG. 1A shown in the locked position.

As shown in FIG. 1C, once the sliding gate 20 has been moved along its full excursion path, the toe 18 of the shackle 14 may be rotated about the axis of the heel 16 to unlock the lock. In order to permit such rotation, while still maintaining engagement of the heel 16 with the body 12, the heel may be provided with a recessed channel 22 extending around its entire diameter as shown in FIG. 1D. The channel may then be mated against a ball bearing 24 floating freely within an internal chamber 26 delimited by the body 12. It will be appreciated that the chamber 26 is preferably only slightly larger than the ball bearing 24, such that the ball bearing is not free to become disengaged from the channel 22. This arrangement of parts permits the heel 16 of the shackle 14 to be rotated freely, but not lifted from within the body 12. The pullout strength of the shackle 14 will therefore be determined by several factors, among them the compressive strength of the ball bearing 24, the strength of the materials utilized for the body 12, and the tensile strength of the shackle material remaining at the channel 22. Such materials may be chosen and sized accordingly.

Additional pullout strength for the shackle may be achieved by providing a retaining system at the toe 18 of the shackle 14 in addition to that found at the heel 16. In this regard, the toe 18 of the shackle 14 may incorporate a slot 28 recessed into the toe. (The slot being shown most clearly in FIG. 1C). The body 12 of the lock 10A may then be provided with a bar 30 spanning the cavity 32 in which the toe 18 resides when the lock is in the locked position. In the locked position, the slot 28 of the toe 18 may be mated with the bar 30, such that the toe 18 may not be easily pulled from within the body 12. The pullout strength of the toe 18 is therefore governed by the shackle material remaining beside the slot, the bending strength of the bar 30, and the strength of the materials used for the lock body 12. In combination with the ball bearing 24 and channel 22 utilized at the heel 16, the bar 30 and slot 28 at the toe 18 provide the capability for very high security levels, not easily achieved with conventional locks.

Figure 1E:
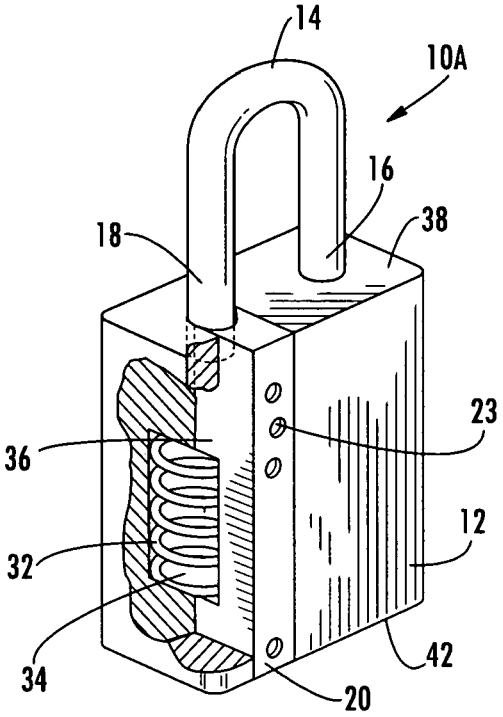
FIG. 1E is another partially cut-away perspective view of the lock of FIG. 1A shown in the locked position.
Figure 1F:
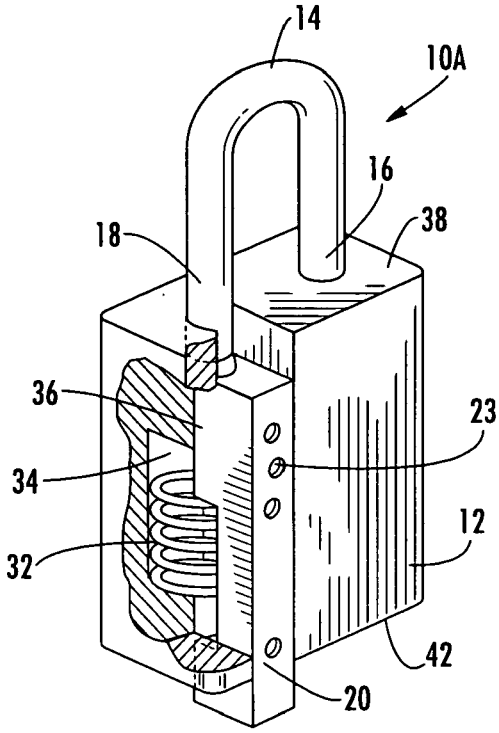
FIG. 1F is a partially cut-away perspective view of the lock of FIG. 1A shown in the partially open position.
Figure 1G:
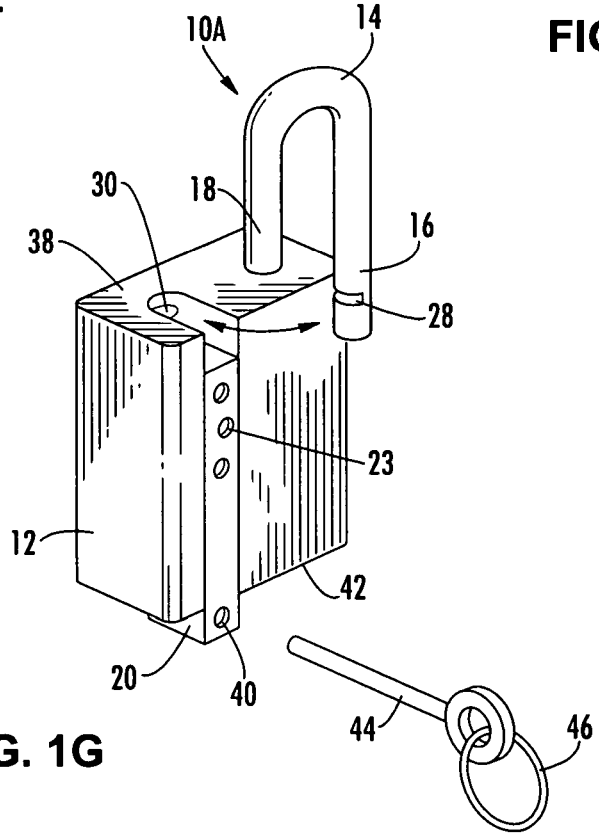
FIG. 1G is a perspective view of the lock of FIG. 1A shown in the open position alongside an instrument adapted for use with the lock.

Adding to the function and security level of the lock is means to resist sliding of the sliding gate 20. As shown in FIGS. 1E and 1F, the sliding gate 20 may be matched with a compressible spring 32 to provide such resistance. In this regard, the spring 32 may reside in a cavity 34 delimited by the lock body 12. In its relatively uncompressed condition, the spring 32 may push a flag portion 36 of the sliding gate 20 toward the top 38 of the lock 10A, such that the toe 18 of the shackle 14 may be retained as shown in FIG. 1E. Through operation of an appropriate tool, however, the spring 32 may be compressed as shown in FIG. 1F, such that the toe 18 of the shackle 14 may be free to rotate. It will be appreciated that various strength springs 32 may be utilized, and that the strength of the spring will partially determine the security level of the lock 10A.

It is preferred that the spring 32 be of sufficient strength to return the sliding gate 20 to the locked position, as shown in FIG. 1E, unless the sliding gate is being influenced by an overpowering force. Therefore, in the natural state of lock 10A, the lock will be locked. In order to keep the lock 10A in an open state, provisions must be made to this preferred embodiment. One such provision is to use a tool operable to keep the lock 10A open. Such a tool will be more fully detailed below. However, there may be occasions where continued interfacing of the tool and the lock 10A is either impossible, or non-ideal.

Accordingly, the lock 10A may be provided with an aperture 40 extending through the sliding gate 20. The aperture 40 may be located sufficiently toward the bottom 42 of the lock 10A, such that the aperture clears the bottom of the lock when the sliding gate 20 is brought through its full excursion. A pin 44, or similar long and slender generally cylindrical element, may be placed through the aperture 40 such that the pin 44 butts up against the bottom 42 of the lock 10A to prevent the sliding gate 20 to return to its locked position toward the top 38 of the lock. The pin 44 may be provided with grasping means, such as a ring 46, which may act as a handle to enable a user to withdraw the pin from the aperture 40 in a relatively easy manner. Alternatively, an operator may be required to utilize conventional tools, such as pliers, to pull the pin 44 from the aperture due to the strength of the spring 32.

Figure 2A:
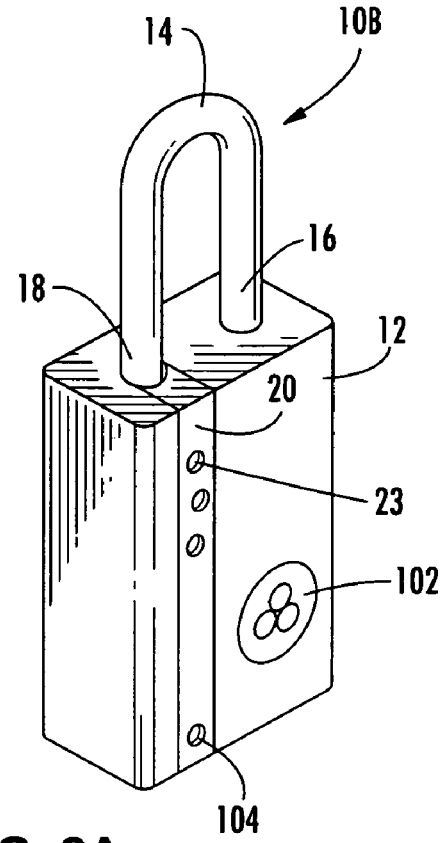
FIG. 2A is a perspective view of a lock in accordance with another aspect of the present invention shown in the locked position.

A further embodiment of a lock 10B made in accordance with certain aspects of the present invention is shown in FIG. 2A. As with the previous embodiment, this embodiment of a lock 10B secures the toe 18 of the shackle 14 with sliding gate 20. Generally speaking, this second embodiment differs from the first embodiment, shown and described with respect to FIGS. 1A-1F, in that it employs the addition of a second locking mechanism. In this instance, the second locking mechanism is provided in the form of an internal latch, not shown, preventing motion of the sliding gate 20 until released by rotation of a tool-engaging interface 102. The tool-engaging interface may include various patterns which a tool must engage in order to rotate the tool-engaging interface. The tool will typically feature a male extension of the pattern while the tool-engaging interface 102 is female. Such patterns may be made to virtually unlimited combinations, and may be similar to those employed by products sold under the name McGard®. McGard® is a registered trademark of McGard, Inc., 862 Kensington Avenue, Buffalo, N.Y. 14215 (USA).

Internal latch mechanisms that may be utilized in conjunction with the tool-engaging interface 102 are generally known in the industry, and may comprise a retractable shaft extending into the sliding gate 20, such that counter-clockwise rotation of the tool-engaging interface retracts the shaft from within the sliding gate and clockwise rotation extends the shaft into the sliding gate, or vice-versa. The internal latch mechanism may also be key operable, such that the tool-engaging interface is replaced with a keyed cylinder, still operating under generally the same principles.

Figure 2B:
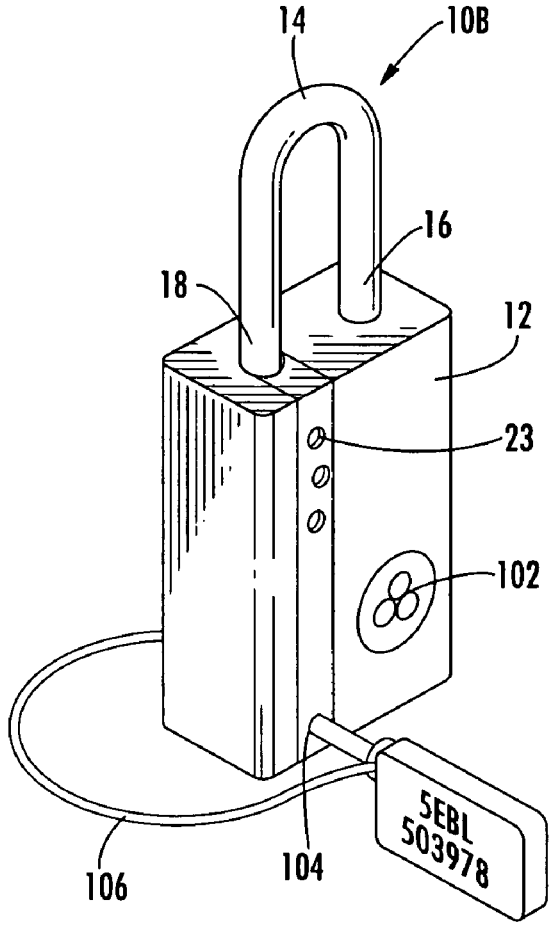
FIG. 2B is a perspective view of the lock of FIG. 2A being utilized in conjunction with a tamper indicative device.

As shown in FIG. 2B, an additional security feature may be provided to the lock 10B by the addition of an aperture 104 through sliding gate 20 and body 12, formed when the sliding gate is in the locked position, toward the top 38 of the lock body 12. Aperture 104 provides for the engagement of a tamper indicative device 106. Translation of sliding gate 20 with respect to body 12 will shear the tamper indicative device 106 along a shear plane formed between the sliding gate 20 and body 12, indicating tampering with or opening of the lock 10B.

Figure 2C:
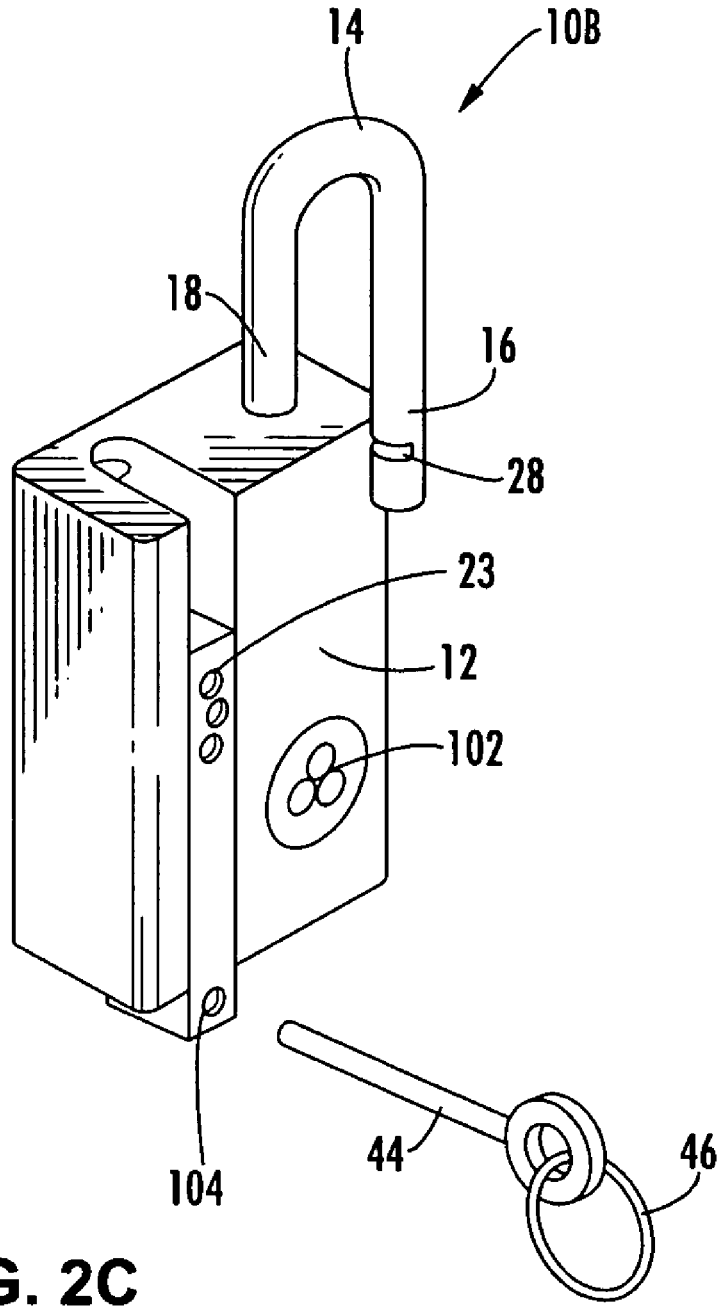
FIG. 2C is a perspective view of the lock of FIG. 2A shown in the open position alongside a tool adapted for use with the lock.

It will also be appreciated that as with the previous embodiments, aperture 40 of the sliding gate 20, utilized to form a portion of aperture 104 of the lock body 12, may be utilized to maintain the lock in an open position, with, for example, a pin 44, as previously discussed and as shown in FIG. 2C. It will therefore also be appreciated that the aperture 40 of sliding gate 20 may also be utilized in other embodiments to house a tamper indicative element 106, such as a seal. Provisions in the lock body 12, such as a matching aperture, may therefore be provided in the lock.

Figure 3B:
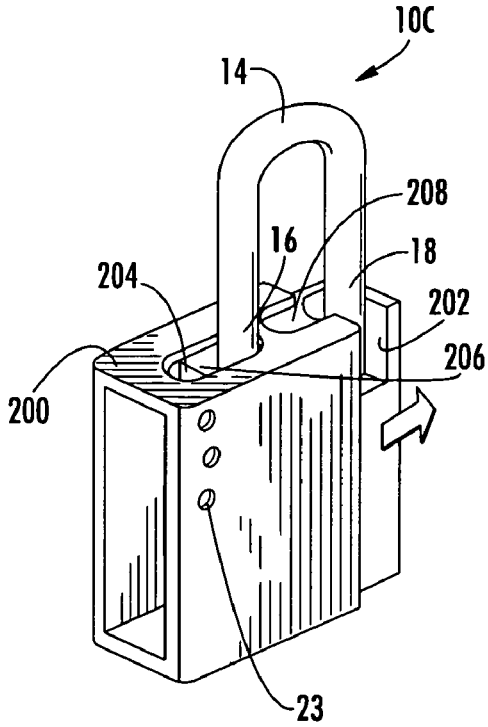
FIG. 3B is a perspective view of the lock of FIG. 3A shown in the open position.

In another embodiment of a lock constructed in accordance with aspects of the present invention, a lock may include a sliding outer housing, which may be shifted to reveal the toe of a shackle and allow rotation thereof about the heel. Such a lock 10C is shown in FIGS. 3A and 3B. As shown in FIG. 3A, the lock 10C may comprise a body 12 enclosed within a sliding outer housing 200. A shackle 14 having heel 16 and toe 18 portions may be engaged with the body 12. Absent the outer housing 200, the toe 18 is preferably free to rotate about the heel 16. A cavity 202 may be formed in the body 12 to house the toe 18 when the lock 10C is in the locked position. However, unlike previous embodiments of locks discussed herein, there may not be provided a vertically adjusting gate to prevent rotation of the toe 18 out of the cavity 102.

Notwithstanding, such rotation may be prevented by a horizontally sliding outer housing 200. As shown in FIG. 3B, the sliding outer housing 200 may be translated toward the side 204 of the body 12 to reveal the toe 18, or may be translated back over the body to conceal the toe 18. The outer housing 200 may comprise an elongated aperture 206, within which the heel 16 of the shackle 14 may reside. The elongated aperture 206 therefore may provide the means to limit the excursion of the outer housing 200 to only that which is required to reveal the toe 18. A slot 208 may be provided adjacent to the elongated aperture 206 wherein the toe 18 may reside when the lock 10C is in the locked position, such as shown in FIG. 3A.

In a similar manner as discussed with respect to previous embodiments, a spring may be provided within a cavity delimited by the body 12. The outer housing 200 may be influenced by the spring to maintain the lock 10C in the locked position. A tool may be required to overcome the spring and shift the outer housing 200 to the open position. Mating elements 23 may be provided on the front face 210 of the outer housing 200, to enable a tool to interface with the lock 10C. It will be appreciated that a spring may not be provided in certain embodiments. In this regard, the shifting of the outer housing 200 relative to the body 12 may be relatively free, and only restricted by the friction inherent between the outer housing and the body. Depending on the tolerances utilized during manufacturing, the level of friction may be quite high, even for high security locks.

Figure 4A:
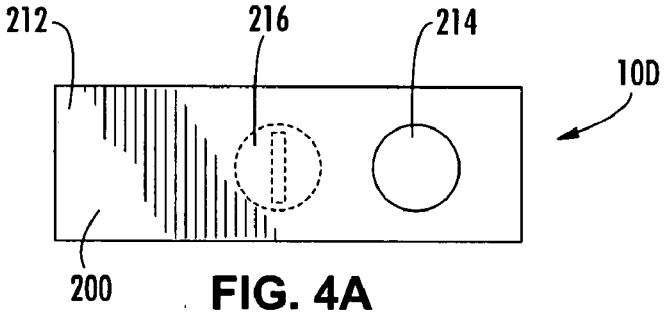
FIG. 4A is bottom view of a lock in accordance with a still further aspect of the present invention shown in the locked position.
Figure 4B:
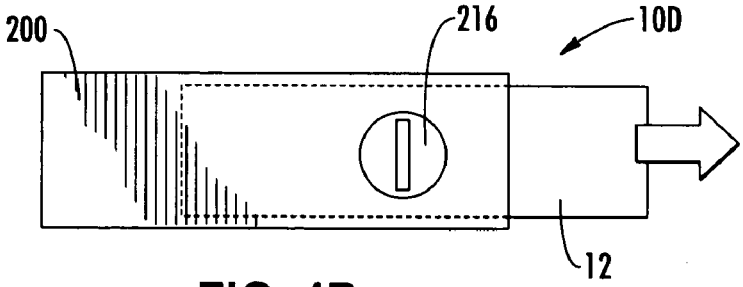
FIG. 4B is a bottom view of the lock of FIG. 4A shown in the partially open position.

To provide an additional level of security to the locks shown and described with respect to FIGS. 3A and 3B, a second locking mechanism may be added. Bottom views of a lock 10D having an example of a second locking mechanism are shown in FIGS. 4A and 4B. As shown, the bottom surface 212 of the outer housing 200 of lock 10D may include an aperture 214. In the closed position, shown in FIG. 4A, the aperture 214 reveals a portion of the body 12 which is uneventful. However, as shown in phantom in FIG. 4A, a lock mechanism, such as a conventional cylinder 216, may reside within the body 12 adjacent to the aperture 214. When the outer housing 200 is moved to the open position, as shown in FIG. 4B, the cylinder 216 and the aperture 214 may align, such that the cylinder is exposed for manipulation. The cylinder 216 may control the unlatching of the toe 18, such that even though the outer housing 200 is opened, the toe may not be free to rotate about the heel 16 absent proper manipulation of the cylinder 216 with an appropriate key. In this regard, a second level of security for the lock 10D may be provided.

Figure 5A:
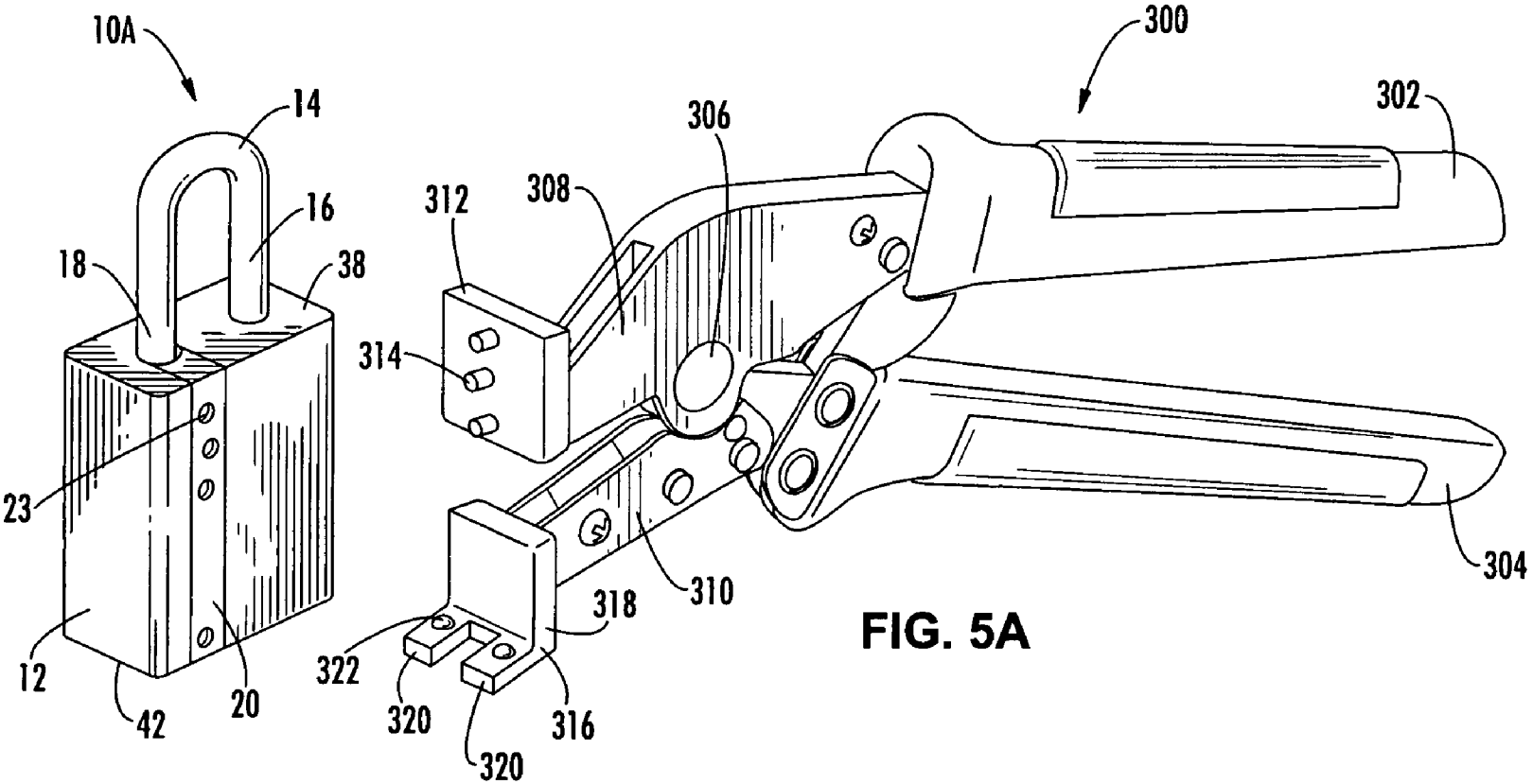
FIG. 5A is a perspective view of a tool in accordance with one aspect of the present invention alongside a lock of the type shown in FIG. 1A in the closed position; and, FIG. 5B is a perspective view of the tool of FIG. 5A opening a lock of the type shown in FIG. 1A.

FIG. 5A depicts a preferred embodiment of a tool 300 which may be utilized to unlock locks, such as lock 10A shown beside the tool 300 and otherwise previously described with respect to FIGS. 1A–1G, and the text related thereto.

The specialized tool 300 may comprise an upper handle 302 and a lower handle 304 hinged together by a hinge assembly 306. The hinge assembly 306 may in turn be connected to an upper jaw 308 and a lower jaw 310 in a scissor-like engagement. The hinge assembly 306 may be designed with an internal ratchet mechanism (not shown) which positions the jaws 308, 310 in proximity to each other upon repeated ratcheting of the handles 302, 304. The ratchet mechanism may then be released to permit the jaws 308, 310 to open, such that they are apart from each other. Such ratchet mechanisms are known in the art, and may be similar to those utilized in ratcheted crimping tools commonly available.

It will be appreciated that the number of ratchet sweeps, or handle pumps, required to completely close the jaws 308, 310 may be engineered in accordance with the compression load required by the lock 10A to shift the sliding gate 20 relative to the body 12 by compressing the spring 32. For locks 10A that only require a relatively light load, the lock may be opened in a single pump. For higher security locks 10A, multiple pumps may be required to provide the excursion distance required to unlock the lock without the need for an abundant amount of force at the handle 302, 304. In each case, the length of the handles 302, 304 will also be a factor affecting the force required to be applied.

Preferably, the upper jaw 308 terminates with a relatively flat backing member 312 with pins 314 extending perpendicularly therefrom. The pins 314 are preferably adapted to fit within each of the mating elements 23 of the lock 10A. The lower jaw 310 preferably terminates with an L-shaped backing member 316 having a backing portion 318 and a pair of ledges 320 extending perpendicularly therefrom. The ledges 320 may include bulges 322 which may fit within dimples (not shown) in the bottom 42 of the lock 10A to ensure that the lock mates positively with the tool 300.

Figure 5B:
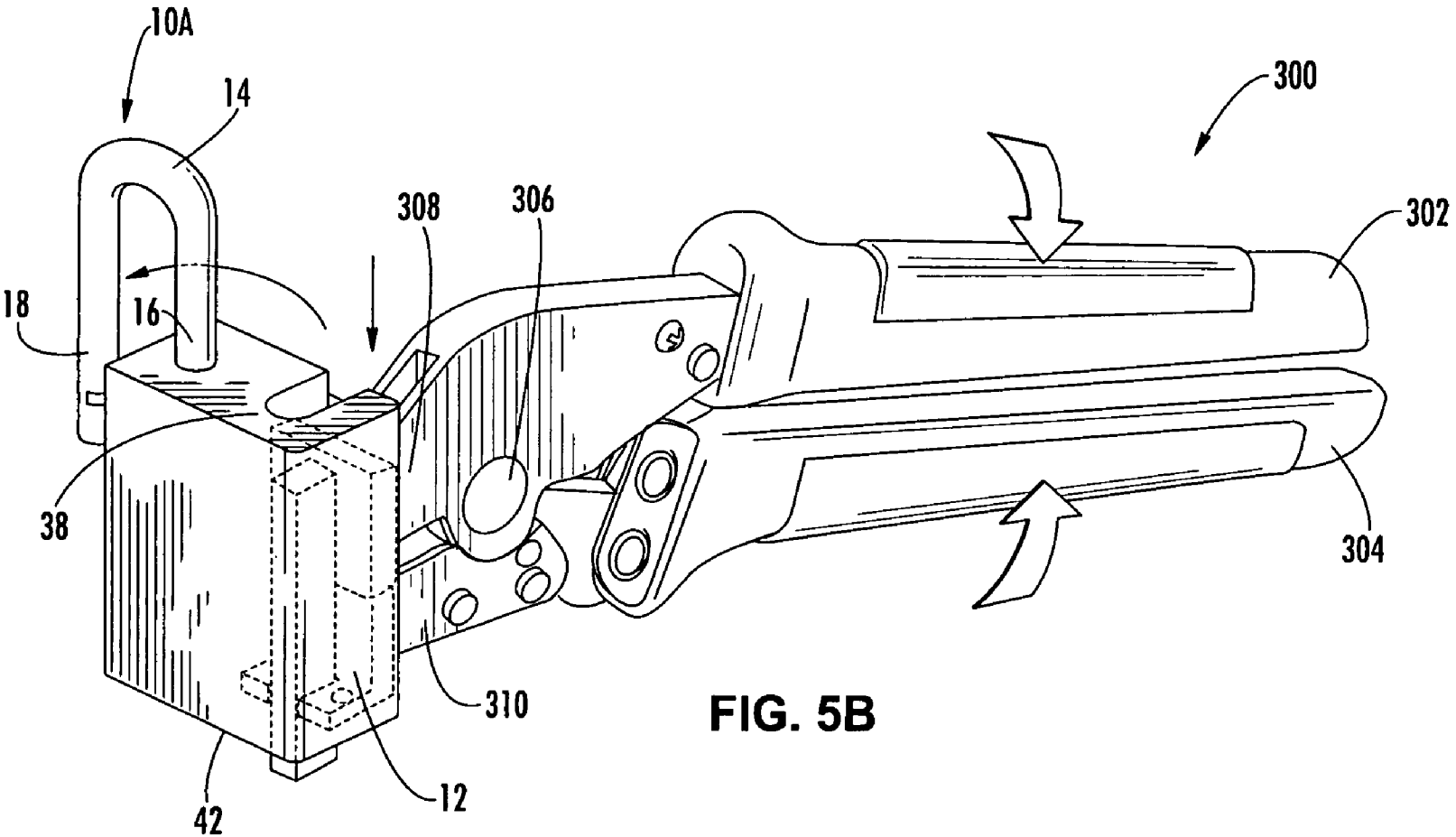

To unlock the lock 10A, the lock may be positioned between the upper jaw 308 and the lower jaw 310, when the jaws are spaced apart, with the pins 314 placed within mating elements 23 and the bulges 322 positioned within the dimples provided in the bottom surface 42 of the body 12. The handles 302, 304 may then be squeezed toward each other to bring the upper jaw 308 toward the lower jaw 310. Depending on the arrangement of the tool 300, the handles 302, 304 may require several ratcheted excursions. As the jaws 308, 310 are brought into proximity, it will be appreciated that the sliding gate 20 will begin to shift with respect to the body 12 of the lock 10A until the sliding gate and the body are in the positions shown in FIG. 5B, such that the shackle 14 may be swung to the open position. If so provided, the lock 10A may then be left within the tool 300 until such time that the ratchet mechanism is released. Alternatively, a pin or similar device, as discussed, may be utilized to maintain the lock 10A in the open position even when the tool 300 is disconnected.

It will be appreciated that the ratcheting tool 300 shown and described herein may exert a large force upon the lock 10A. As known with such ratcheting devices, one stroke of the handles 302, 304 may impart a certain excursion of the jaws 308, 310. The gear ratio between the two may be engineered such that the handle stroke requires only the amount of force that the designer intends, which is preferably much less than would be otherwise required without the mechanical advantage offered by such a tool. Preferably, the number of strokes required to complete the unlocking of a lock 10A is not so great as to inhibit the timeliness of an application, or to invoke more strokes than is necessary. In this regard, an appropriate balance between the number of strokes and the force required is preferably made in accordance with design parameters deemed appropriate for the given application.

It will be appreciated, however, that other tools, such as non-ratcheting tools, may also be utilized. Non-ratcheting tools are particularly preferred in applications where the mechanical advantage offered by the length of the handles 302, 304 is sufficient to overcome the force required to move the sliding gate 20 relative to the body 12 without the need for ratcheting devices to impart additional mechanical advantage as non-ratcheting tools are often lighter, less complicated, and generally easier to use.

It is also anticipated that the tool may be power driven, for example by electric, pneumatic, or hydraulic power, as previously alluded to. Finally, the tool may incorporate additional features, as discussed, to raise the security level of the tool and to make the tool a "not so dumb" tool or a "smart" tool.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

For example, locks have been shown herein that incorporate U-shaped shackles having toe portions capable of exiting from within the lock body via rotation about a heel portion of the shackle. Several embodiments of such locks have been shown with sliding gates selectively permitting or restricting such rotation. Rather than a sliding gate, other gates may also be utilized. Primarily, other gates are envisioned to include rotational movement, such that rotation of the gate to a first position permits rotation of the toe portion of the shackle about the heel portion of the shackle, and rotation to a second position does not. Other embodiments may incorporate helical movement of the gate.

What is claimed is:

1. A lock comprising:

a body having a cutout through a side portion;

an outer shell partially surrounding said body;

a shackle, said shackle having a first end affixed to said body such that said first end is capable of rotation, and said shackle having a second end adapted to fit within said cutout;

wherein said outer shell is adapted to slide relative to said body between a first position concealing said cutout and a second position relative to said body revealing said cutout, said second end of said shackle being free to enter or leave said cutout when said outer shell is in said second position, movement of said outer shell being in a direction perpendicular to said shackle when said outer shell is moved between said first position and said second position.

2. The lock of claim 1, wherein said outer shell further comprises at least one mating element, said mating element adapted to associate with a tool to move said outer shell between said first position and said second position.

3. The lock of claim 2, wherein said at least one mating element comprises at least one aperture.

4. The lock of claim 1, wherein said lock further comprises a spring arranged in said body and adapted to bias said outer shell toward said first position.

5. The lock of claim 1, wherein said outer shell further comprises an elongated aperture through which said first end of said shackle extends.

6. The lock of claim 5, wherein said elongated aperture defines the limit of excursion of said outer shell relative to said body.

7. The lock of claim 6, wherein said outer shell further comprises an opening, said opening being flush with said body when said outer shell is in said first position.

8. The lock of claim 1, wherein said lock further comprises a locking mechanism, said locking mechanism selectively moveable between a lock position and an unlock position, said locking mechanism preventing rotation of said shackle when in said lock position and permitting rotation of said shackle about said first end when in said unlock position.

9. The lock of claim 8, wherein said locking mechanism is only capable of selectively moving between said lock position and said unlock position when said outer shell is in said second position.

10. The lock of claim 8, wherein said outer shell further comprises an aperture, said aperture being moved into registration with said locking mechanism when said outer shell is in said second position, and said outer shell covering said locking mechanism when said outer shell is in said first position.

11. A lock comprising:

a body having a cutout through a side portion;

an outer shell partially surrounding said body;

a shackle, said shackle having a first end affixed to said body such that said first end is capable of rotation, and said shackle having a second end adapted to fit within said cutout;

wherein said outer shell is adapted to slide relative to said body between a first position concealing said cutout and a second position relative to said body revealing said cutout, said second end of said shackle being free to enter or leave said cutout when said outer shell is in said second position;

said lock further comprising a spring arranged in said body and adapted to bias said outer shell toward said first position.

12. A lock comprising:

a body having a cutout through a side portion;

an outer shell partially surrounding said body;

a shackle, said shackle having a first end affixed to said body such that said first end is capable of rotation, and said shackle having a second end adapted to fit within said cutout;

wherein said outer shell is adapted to slide relative to said body between a first position concealing said cutout and a second position relative to said body revealing said cutout, said second end of said shackle being free to enter or leave said cutout when said outer shell is in said second position;

wherein said outer shell further comprises an elongated aperture through which said first end of said shackle extends, said elongated aperture defining the limit of excursion of said outer shell relative to said body.

13. The lock of claim 12, wherein said outer shell further comprises an opening, said opening being flush with said body when said outer shell is in said first position.

14. A lock comprising:

a body having a cutout through a side portion;

an outer shell partially surrounding said body;

a shackle, said shackle having a first end affixed to said body such that said first end is capable of rotation, and said shackle having a second end adapted to fit within said cutout;

wherein said outer shell is adapted to slide relative to said body between a first position concealing said cutout and a second position relative to said body revealing said cutout, said second end of said shackle being free to enter or leave said cutout when said outer shell is in said second position;

said lock further comprising a locking mechanism, said locking mechanism selectively moveable between a lock position and an unlock position, said locking mechanism preventing rotation of said shackle when in said lock position and permitting rotation of said shackle about said first end when in said unlock position, said locking mechanism being only capable of selectively moving between said lock position and said unlock position when said outer shell is in said second position.

15. A lock comprising:

a body having a cutout through a side portion;

an outer shell partially surrounding said body;

a shackle, said shackle having a first end affixed to said body such that said first end is capable of rotation, and said shackle having a second end adapted to fit within said cutout;

wherein said outer shell is adapted to slide relative to said body between a first position concealing said cutout and a second position relative to said body revealing said cutout, said second end of said shackle being free to enter or leave said cutout when said outer shell is in said second position;

said lock further comprising a locking mechanism, said locking mechanism selectively moveable between a lock position and an unlock position, said locking mechanism preventing rotation of said shackle when in said lock position and permitting rotation of said shackle about said first end when in said unlock position, said outer shell further comprising an aperture, said aperture being moved into registration with said locking mechanism when said outer shell is in said second position, and said outer shell covering said locking mechanism when said outer shell is in said first position.

* * * * *